US007451890B2

(12) United States Patent
Ivey

(10) Patent No.: US 7,451,890 B2
(45) Date of Patent: Nov. 18, 2008

(54) SELF RIGHTING CONTAINER

(75) Inventor: Jason Ivey, Anaheim, CA (US)

(73) Assignee: Icon Development Group, Inc., Santa Ana, CA (US)

( * ) Notice: Subject to any disclaimer, the term of this patent is extended or adjusted under 35 U.S.C. 154(b) by 0 days.

(21) Appl. No.: 11/206,344

(22) Filed: Aug. 17, 2005

(65) Prior Publication Data

US 2007/0039970 A1 Feb. 22, 2007

(51) Int. Cl.

| | |
|---|---|
| ***B65D 25/38*** | (2006.01) |
| ***B65H 3/16*** | (2006.01) |
| *B65D 8/02* | (2006.01) |
| *B65D 6/40* | (2006.01) |

(52) U.S. Cl. ..... 220/603; 220/631; 221/212

(58) Field of Classification Search ..... 220/603, 220/629, 631; 221/212, 188, 189, 210
See application file for complete search history.

(56) References Cited

U.S. PATENT DOCUMENTS

| | | | | | |
|---|---|---|---|---|---|
| 2,341,092 | A * | 2/1944 | Gooden | 131/242 |
| 2,457,421 | A * | 12/1948 | Warren | 335/285 |
| 3,706,140 | A * | 12/1972 | Brillaud et al. | 34/60 |
| 4,058,209 | A * | 11/1977 | Schmidt | 206/350 |
| 4,221,293 | A * | 9/1980 | Anthony | 206/494 |
| 5,097,947 | A * | 3/1992 | Hsu | 206/214 |
| 5,372,269 | A * | 12/1994 | Sutton et al. | 220/62 |
| 6,244,464 | B1 * | 6/2001 | Goserud | 221/155 |
| 6,457,604 | B1 * | 10/2002 | McNabb | 220/737 |
| 6,464,078 | B1 * | 10/2002 | Grossnickle | 206/459.5 |
| 6,783,033 | B1 * | 8/2004 | Chan | 222/166 |
| 6,793,094 | B2 * | 9/2004 | Turnbough | 220/603 |
| 2002/0033397 | A1 * | 3/2002 | Henson | 220/603 |
| 2004/0094558 | A1 * | 5/2004 | Najd | 220/603 |

* cited by examiner

*Primary Examiner*—Anthony D Stashick
*Assistant Examiner*—Niki M. Eloshway
(74) *Attorney, Agent, or Firm*—The Soni Law Firm

(57) ABSTRACT

A self righting container having a hollow and generally spherical shape and an eccentrically weighted ballast. Upon rotation or other movement of the container, the weighted ballast urges the container to return to a predetermined orientation, typically determiner such that a container opening would be positioned at a desired location. The weighted ballast may further comprise a magnet such that metallic objects may be contained within the interior of the container and may even be retained in a particular orientation as determined by the magnetic forces. As the container is a highly desirable device, especially for office locations, graphical or advertising material may be imprinted on at least one portion of its outer surface for the purpose of providing advertising or promotion.

9 Claims, 1 Drawing Sheet

SELF RIGHTING CONTAINER

BACKGROUND OF THE INVENTION

The present invention is directed to the design and configuration of a container for the retention of small articles. More specifically, the present invention is directed to a container which would commonly be used for storage of small articles, such as paper clips, on the desk of an office worker.

Containers for small articles have been known for some time. In an hectic office situation, however, containers for clips and other small articles are often susceptible of being knocked about and even falling off the desk or table surface. When this event would occur, the individual is left with at the least, a mess, and at worst, further damage or breakage may result from the container hitting the floor.

Self righting devices have been designed in the past but each is either too limited to accomplish the desired intent of the present invention or unduly complex. For example, European Patent Application No. 0661010A1, to Hannoosh, describes a self righting mechanism for use as the base of a walking cane. This cane incorporates a weighted hemispherical base to accomplish the swaying capability for self righting. While the spherical portion is somewhat similar to the present invention, the Hannoosh device is not a container and is not spherical. It simply illustrates the principal that a weighted round base will tend to maintain a particular orientation. U.S. Pat. No. 4,707,686 to Smith further illustrates a complex self eccentrically weighted device which is intended to roll uphill. While this device includes weighted component and is specifically designed to function as a limited travel rolling device.

Spherical containers have been designed in many configurations and some incorporate a self righting capability. For example, U.S. Pat. No. 4,732,387 to Elinski discloses a spherical ball container for the dispensing of small balls such as those used in a lottery number selection. While spherical, this container has no self righting capability. U.S. Pat. No. 5,860,552, to Culhane, et al., is an eccentric shaped lid for a liquid container which serves to orient the container in a particular configuration in the event it tips over. This device, however, would only orient the device if it were to fall on its side and it has no capability to reorient the container through a rotation of any angle about any axis, such as if the container were to fall on its lid.

U.S. Patent Application No. 2003/0213706, to Huang, describes a magnetic container in which two magnets mounted at opposite chordal ends of a container invoke a magnetic field in order to orient steel objects therein, such as paper clips, in a vertical orientation. While this device is spherical and weighted, it is incapable of reorienting the device in a particular desired orientation regardless of the degree of rotation or axis thereof. The Huang device is limited by its duality of weighted magnets as well as its large opening.

What is lacking in the prior art is a self righting container for the retention of small articles which will independently reorient itself when dropped, rolled or otherwise handled, regardless of the extent of movement, rotation or axis about which it is rotated. What would be desirable would be a small container with self righting capability that could also orient and retain metallic pieces with a very simple magnetic action. Another desirable feature of a small self righting container would be a lid which could be slid over, snapped or placed upon an opening of the container to seal its contents.

SUMMARY OF THE INVENTION

An object of the present invention is to provide a self righting device in which various small items may be stored. Another object of the invention is to enable the device to not only be self righting but to be capable of unlimited rotation through any possible axis of rotation and upon cessation of the rotation, to return immediately to a predetermined and desired orientation.

Yet another object of the invention is to provide a magnetic receptacle for the storage of small metallic items, such as paper clips. Still another object of the invention is to provide the self righting container with a lid or other closure for the aperture or opening in the container. In so doing, the container may be utilized for the storage or conveyance of a greater variety of contained materials.

The objects of this invention are accomplished by incorporating a hollow spherical shell with at least one opening with an eccentric weighting device. As the object is rotated or otherwise moved, the weighted portion of the sphere will be urged to then come to rest at the lowest vertical point of the resting sphere. In so doing, the user or the fabricator of the device can easily configure the device to utilize this predetermined positioning to place the opening at a desired location relative to the sphere at rest. By so locating the opening, whether closed or open, the designer may have the opening in the optimum location about the sphere to achieve the desired purpose of the device. For example, the designer may want the opening to be located at the extreme top or bottom of the sphere in use, in order to best retain or best dispense a particular item stored therein. In closing the opening with a sliding, snapping or other type of lid or closure, the designer may utilize the container for a greater variety of materials. The device may even be used for the storage of a liquid, if the lid is properly sealed. The use of a liquid or other medium in the container not only improves its versatility, but may also enhance its aesthetic appeal by creating a very different visual effect in the product.

In order to accomplish the desired purpose, the present invention comprises a container and a biasing means, with the container typically being a two piece joined hollow shell and having a generally spherical shape with at least one opening. The biasing means would typically comprise an eccentrically weighted ballast which is affixed to the inside of the container shell so as to urge the container into a substantially upright orientation. Top further enhance the usefulness of the device, the ballast could be a magnet for the positioning of and storage of metallic items, such as paper clips.

BRIEF DESCRIPTION OF THE DRAWINGS

The foregoing objects, features, advantages and preferred embodiments of the evacuation unit and method of the present invention will be better understood from the following detailed description taken in conjunction with the accompanying drawings in which.

DETAILED DESCRIPTION OF THE INVENTION

The accompanying Figures depict embodiments of the present invention, and features and components thereof. With regard to means for fastening, mounting, attaching or connecting the components of the present invention to form the apparatus as a whole, unless specifically described otherwise, such means are intended to at least encompass conventional fasteners such as machine screws, machine threads, snap rings, hose clamps such as screw clamps and the like, rivets, nuts and bolts, toggles, pins and the like. Components may also be connected by friction fitting, snap fitting, adhesives, or by welding or deformation, if appropriate. Unless specifically otherwise disclosed or taught, materials for making components of the present invention are selected from appropriate materials such as metal, metallic alloys, natural or synthetic fibers, plastics and the like, and appropriate manufacturing or production methods including casting, extruding, molding and machining may be used.

Any references to front and back, right and left, top and bottom, upper and lower, and horizontal and vertical are intended for convenience of description, not to limit the present invention or its components to any one positional or spacial orientation.

Figure 1:
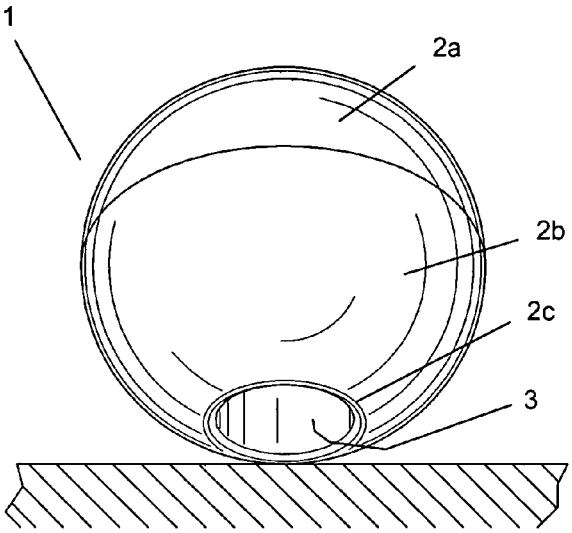
FIG. 1 depicts a preferred embodiment of the container having a two piece shell and an opening located in a position whereby it will be at the lowest vertical point of the container when at rest.
Figure 2:
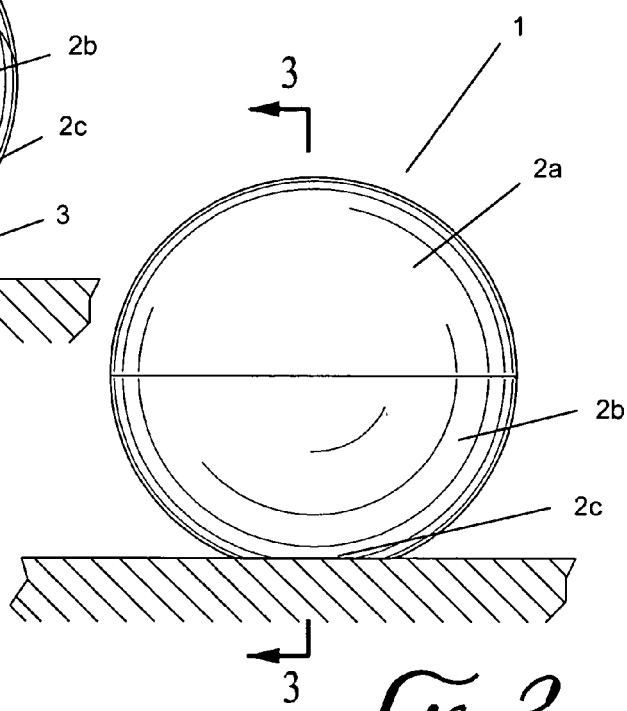
FIG. 2 shows a preferred embodiment of the container having a two piece shell with the opening located in a position whereby it is at the lowest vertical point of the container when at rest.

Referring now to FIGS. 1 and 2, in the preferred embodiment, container 1, comprises a shell having two piece construction. The shell has an upper half 2*a* and a lower half 2*b* in the configuration as depicted in the drawings. This shell would typically be manufactured of a plastic or other polymer type of material for ease of manufacture and low cost. It could, however, be formed from a metallic material or even cast from plaster or other castable material for larger structures or those applications involving an atypical ambient environment or use.

As shown in FIG. 1, the lower half 2*b* may further include an opening 3, through which the contained materials may ingress or egress. The opening 3 may be of various sizes based upon the size of the contained materials, however, a smaller opening 3 is optimum if the designer wishes the device have full rotational capability. In the preferred embodiment as shown, the opening includes a chamfered edge line 2*c*, so as to provide a smooth transition into the opening and to facilitate a stable resting position of the container 1. Regardless of the size of the opening, rotational capability may be obtained by covering the opening with a lid or cap which is contoured to match or closely follow the spherical profile of the outer circumference of the container 1.

Although not shown in the figures, a lid or other closing device for the container may optionally be added to the basic device. This lid may be flat, spherically contoured or can be configured of any reasonable shape to suit the needs and desires of the user. For example, the lid could incorporate a sealing surface between the lid and the opening 3 and it may be pressed, threaded, adhered or otherwise mated into the opening. Alternatively, the lid may be hinged, pinned or otherwise slid over the opening 3.

Figure 3:
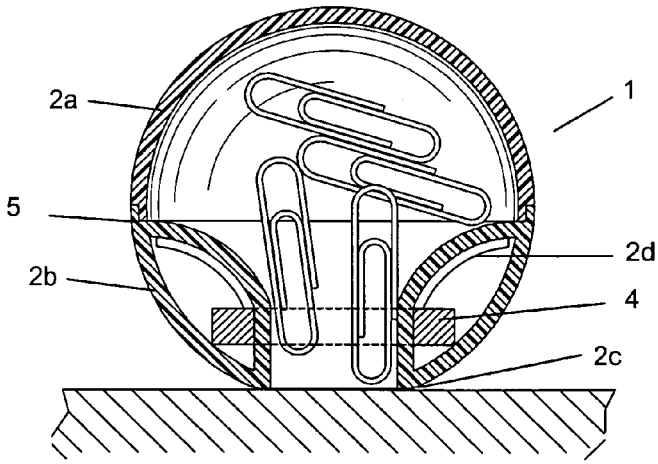
FIG. 3 is a vertically sectioned view of a preferred embodiment of the spherical container showing the eccentric weighted ballast located inboard from the opening of the container, so as to urge the opening of the container to the lowest position when at rest.

Referring now to FIG. 3, a cylindrical weighted ballast 4 is shown to be located inboard of the opening 3 of the container 1. The lower half 2*b* of the shell in the preferred embodiment further includes a set of buttress ribs 2*d*, which support an internal curved surface 5 upon which the ballast 4 is mounted. The purpose of this curved surface is twofold. In addition to serving as the support and mounting aspect for the ballast 4, the curved surface 5 provides a smoothly radiased aspect to further enhance the ingress and egress of materials into and out of the container 1.

Based on the desired performance aspects of the container 1, the ballast 4 may be fabricated from a variety of shapes and materials. For example, in a typical example of the container 1 in use as a paper clip holder and dispenser, the ballast 4 may be magnetic, so as to maintain a group of paperclips at or near the opening, within easy reach of the user.

Although the preferred embodiment depicts the container 1 as having a spherical shape, it need not be perfectly spherical. For example, it could be dimpled like a golf ball outer surface and still perform satisfactorily. Moreover, the container need not be fabricated as a mere shell. Instead, it is contemplated that the device be constructed of an inner and outer shell which, when joined, create an encapsulated space between the shells. In so doing, a liquid could be retained between the shells, which may enhance both the performance of and the aesthetic appeal of the product. Moreover, based on the internal configuration of and volume of the open space between such an inner and outer shelled product, the liquid could, in fact, perform the function of the weighted ballast to eliminate the need for a secondary weighted ballast 5 or to create interesting rolling characteristics for the product.

The present invention may be embodied in other specific forms without departing from the essential spirit or attributes thereof. It is desired that the embodiments described herein be considered in all respects as illustrative, not restrictive, and that reference be made to the appended claims for determining the scope of the invention.

What is claimed is:

1. A self righting device comprising:

a substantially hollow container having a generally spherical shell with a top portion, an opposing bottom portion, a generally spherical inner cavity extending therebetween for retaining objects therein, and a means for biasing the container into a substantially upright orientation, graphical or advertising material being imprinted on said top portion for providing advertising or promotion;

said container defining only one opening on said bottom portion thereof, said opening being permanently exposed to an exterior of the device and extending into the spherical inner cavity for providing access thereto; and said biasing means comprising a single weighted ballast eccentrically disposed in a predetermined position inside the container adjacent said opening so as to urge the container into the substantially upright orientation such that said opening is located at the lowermost point of the container adjacent said bottom portion thereof, and the graphical or advertising material is visible when the container is positioned in the substantially upright orientation.

2. The self righting device of claim 1 wherein the spherical shape further includes at least one flat area.

3. The self righting device of claim 1 wherein the weighted ballast is annular shaped.

4. The self righting device of claim 1 wherein the weighted ballast is a magnet.

5. The self righting device of claim 1 wherein the weighted ballast is a liquid.

6. The self righting device of claim 1 wherein the weighted ballast is located in a fixed position within the interior of the container such that at least one opening is located at the uppermost point of the container when it is urged into a substantially upright orientation.

7. The self righting device of claim 1 wherein the ballast is inwardly recessed from the opening so as to allow objects to be retained within the cavity.

8. A self righting device comprising:

a substantially hollow container having a generally spherical shell with a top portion, an opposing bottom portion, a generally spherical inner cavity extending therebetween for retaining objects therein, and a means for biasing the container into a substantially upright orientation, graphical or advertising material being imprinted on said top portion for providing advertising or promotion; and said container defining only one opening on said bottom portion thereof, said opening being permanently exposed to an exterior of the device and extending into the spherical inner cavity for providing access thereto, wherein a circumferential edge of the opening truncates the spherical shell at the bottom portion to define a substantially flat plane therewith such that the container rests flush upon flat surfaces thereby when urged into the substantially upright orientation; and said biasing means comprising a single weighted ballast eccentrically disposed in a predetermined position inside the container adjacent said opening so as to urge the container into the substantially upright orientation such that said opening is located at the lowermost point of the container adjacent said bottom portion thereof, and the graphical or advertising material is visible when the container is positioned in the substantially upright orientation.

9. The self righting device of claim 8 wherein the ballast is inwardly recessed from the opening so as to allow objects to be retained within the cavity.

* * * * *